United States Patent [19]

Goto et al.

[11] Patent Number: 4,830,825

[45] Date of Patent: May 16, 1989

[54] CORROSION-RESISTANT COPPER ALLOY

[75] Inventors: Sachio Goto; Hideo Kobayashi, both of Tokyo; Akira Yasumori, Kawagoe; Tsutomu Kimura, Kumagaya; Hiroshi Hayashi, Kitamoto, all of Japan

[73] Assignees: Mitsubishi Kinzoku Kabushiki Kaisha; Kusakabe Copastar Company; Sachio Goto, all of Tokyo, Japan

[21] Appl. No.: 95,157

[22] PCT Filed: Nov. 27, 1986

[86] PCT No.: PCT/JP86/00605

§ 371 Date: Sep. 25, 1987

§ 102(e) Date: Sep. 25, 1987

[87] PCT Pub. No.: WO87/03305

PCT Pub. Date: Jun. 4, 1987

[30] Foreign Application Priority Data

Nov. 28, 1985 [JP] Japan ..... 60-267929

[51] Int. Cl.[4] ..... C22C 9/01; C22C 9/06

[52] U.S. Cl. ..... 420/486; 420/485; 420/488

[58] Field of Search ..... 420/485, 486, 488

[56] References Cited

U.S. PATENT DOCUMENTS

| | | | |
|---|---|---|---|
| 3,416,915 | 12/1968 | Mikawa | 420/486 |
| 3,459,544 | 8/1969 | Watanabe | 420/486 |
| 4,401,488 | 8/1983 | Prinz et al. | 420/486 |
| 4,589,938 | 5/1986 | Drosdick | 420/486 |
| 4,594,117 | 6/1986 | Pryor et al. | 420/486 |
| 4,612,167 | 9/1986 | Watanabe et al. | 420/485 |
| 4,634,477 | 1/1987 | Sugimoto et al. | 420/486 |

FOREIGN PATENT DOCUMENTS

| | | | |
|---|---|---|---|
| 0077949 | 5/1985 | Japan | 420/487 |

*Primary Examiner*—Upendra Roy

*Attorney, Agent, or Firm*—Frishauf, Holtz, Goodman & Woodward

[57] ABSTRACT

Disclosed is a corrosion-resistant copper alloy having a composition consisting essentially, by weight, of 5 to 9% of Al, 0.5 to 4% of Ni, 0.5 to 4% of Fe, 0.1 to 3% of Mn, 0.001 to 1% of Ti, at least one selected from 0.001 to 1% of Co and 0.001 to 0.1% of B, and the balance Cu and unavoidable impurities, and a substantially single-phase structure consisting essentially of α-phase. This alloy has excellent weather resistance whereby its beautiful color tone close to gold is able to last for a long time, and further has superior corrosion resistance, particularly, high resistance to corrosion by seawater, together with high strength and excellent cold formability.

8 Claims, 1 Drawing Sheet

CORROSION-RESISTANT COPPER ALLOY

BACKGROUND OF THE INVENTION:

1. Field of the Invention:

The present invention relates to a corrosion-resistant copper alloy which has excellent weather resistance, i.e, resistance to discoloration in the atmosphere and a long-lasting beautiful color tone close to gold, superior corrosion resistance, particularly, high resistance to corrosion by seawater, as well as high strength and excellent cold formability.

2. Description of the Related Art

In the production of marine propellers, tube sheets of heat exchangers in desalination plant, various kinds of valves, automative parts, oil-hydraulic parts, etc., a special aluminum bronze known as a corrosion-resistant copper alloy which has the following composition has heretofore been employed:

Al: 7.5 to 8.5%;
Ni: 0.5 to 2%;
Fe: 3 to 4%;
Mn: 0.5 to 2%; and the balance consisting of Cu and unavoidable impurities (in the above-described composition and in the following description "%" denotes "percent by weight"; this special aluminum bronze will hereinafter be referred to as a "conventional copper alloy").

Although the above-described conventional copper alloy has excellent corrosion resistance, particularly, excellent resistance to corrosion by seawater, and high strength, it suffers from the following problems. In use, the prior art copper alloy is formed into a casting having a predetermined configuration which is produced by casting the molten alloy using, for example, a permanent mold, or the ingot of the copper alloy which is formed by, for example, continuous casting, is subjected to hot forging or hot rolling to form casting or wrought predetermined configuration, and this material is then softened by annealing process in which it is maintained at 600° to 800° C. for 1 to 2 hours. Thus, the conventional copper alloy is made available for practical use in a condition wherein a large amount of crystallized phases such as crystallized Fe and also a large amount of precipitated phases such as intermetallic compounds containing Fe as a principal component and Fe oxides are dispersed in the $\alpha$-phase which defines the matrix of the alloy structure. Accordingly, the conventional copper alloy suffers from inferior weather resistance due to the crystallized phases and the precipitated phases and therefore loses its color easily in the atmosphere and cannot maintain its own beautiful color tone which is close to gold over a long period of time. For this reason, it is impossible to make use of the beautiful golden tone of this alloy for Western tableware, vessels, fittings for buildings and decorative articles. In addition, the prior art disadvantageously has inferior cold formability.

Summary of the Invention

In view of the above-described circumstances, the present inventors made exhaustive studies with a view to imparting excellent weather resistance and cold formability to the above-described conventional copper alloy without degrading its superior properties, i.e., high strength and excellent resistance to corrosion by seawater. As a result, the present inventors have found that a copper alloy, which has a composition consisting essentially of:

Al: 5 to 9%;
Ni: 0.5 to 4%;
Fe: 0.5 to 4%;
Mn: 0.1 to 3%;
Ti: 0.001 to 1%;

at least one selected from

Co: 0.001 to 1%; and
B: 0.001 to 0.1%;

and the balance consisting of Cu and unavoidable impurities; and which, after being processed to a cast material or a hot- or cold-wrought material, is subjected to a heat treatment wherein it is quenched (water cooling or forced air cooling) from a temperature ranging from 800° to 1000° C. to obtain a substantially single-phase structure which consists essentially of $\alpha$-phase, i.e., in which the number of crystallized phases and precipitated phases dispersed in the $\alpha$-phase serving as the matrix is reduced to 50,000/mm$^2$ or less, preferably 30,000/mm$^2$ or less, has high strength and excellent resistance to corrosion by seawater, which properties are equivalent to those of the above-described conventional copper alloy, and yet has much superior weather resistance and consequently loses its color only slightly in the atmosphere and can maintain its beautiful golden tone over a long period of time, the alloy also having excellent cold formability.

The present invention has been accomplished on the basis of the above-described finding. The reason why the composition of the copper alloy according to the present invention is specified as mentioned above will be described hereinunder.

(a) Al:

Although the Al component is effective in improving the strength and resistance to corrosion by seawater, an Al content of less than 5% is insufficient to achieve a desired improvement in the strength and resistance to corrosion by seawater, while an Al content in excess of 9% lowers the weather resistance and cold formability of the alloy. For this reason, the Al content is specified to fall within the range from 5 to 9% inclusive. It should be noted that a preferable Al content is from 7 to 8% inclusive.

(b) Ni:

The Ni component is also effective in improving the strength and resistance to corrosion by seawater of the alloy in the same way as Al. However, a Ni content of less than 0.5% is insufficient to achieve a desired improvement in the strength and resistance to corrosion by seawater, while a Ni content in excess of 4% decreases the hot and cold formability of the alloy. Therefore, the Ni content is specified to fall within the range of from 0.5 to 4% inclusive.

(c) Fe:

Although the Fe component is effective in improving the strength of the alloy, a Fe content of less than 0.5% is insufficient to ensure a desired high strength, while a Fe content in excess of 4% increases the amount of crystallized phases and precipitated phases and this leads to considerably lowering of the weather resistance and cold formability of the alloy. For this reason, the Fe content is specified to be from 0.5 to 4% inclusive.

(d) Mn:

The Mn component has a deoxidizing action and is effective in improving the strength and resistance to corrosion by seawater of the alloy. However, a Mn content of less than 0.1% is insufficient to obtain a desired deoxidizing effect and achieve a desired improvement in the strength and resistance to corrosion by seawater, while a Mn content in excess of 3% decreases the castability of the alloy. Accordingly, the Mn content is specified to fall within the range of from 0.1 to 3% inclusive.

(e) Ti:

Although the Ti component is effective in further improving the weather resistance and cold formability of the alloy, a Ti content of less than 0.001% is insufficient to obtain a desired effect on the improvement, while a Ti content in excess of 1% lowers the fluidity of the molten alloy during casting and this leads to deterioration of the surface condition of the ingot and also to an increase in the amount of precipitation of intermetallic compounds, which results in lowering of the weather resistance and cold formability of the alloy. For this reason, the Ti content is specified to fall within the range of from 0.001 to 1% inclusive.

(f) Co and B:

These components are effective in improving the weather resistance and cold formability of the alloy in coexistence with Ti. However, if the Co content and the B content are less then 0.001% and 0.001%, respectively, it is impossible to obtain a desired effect on the improvement in the weather resistance and cold formability, whereas, if the Co content and the B content exceed 1% and 0.1%, respectively, coarse intermetallic compounds are precipitated in the matrix, resulting in deterioriation of the weather resistance and cold formability of the alloy. Therefore, the Co content and the B content are specified to fall within the range of from 0.001 to 1% inclusive and within the range of from 0.001 to 0.1% inclusive, respectively.

Figure 1:
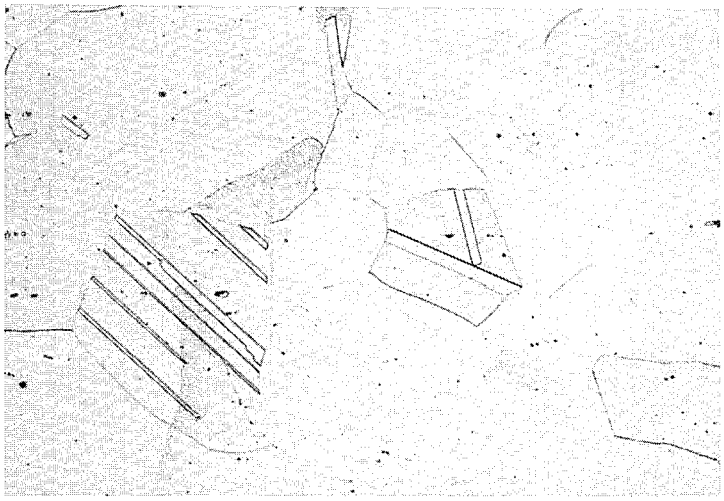
FIG. 1 is a metallurgical microscopic photograph showing the structure of a copper alloy according to the present invention.

DETAILED DESCRIPTION OF THE PREFERRED EMBODIMENTS:

The copper alloy according to the present invention will be described hereinunder in more detail by way of examples.

Alloys respectively having the compositions shown in Table 1 were melted with an ordinary high-frequency induction furnace to produce copper alloys 1 to 12 according to the present invention and comparative copper alloys 1 to 10, each including the following three forms:

(a) a cast material formed by casting the molten alloy using a mold to prepare a columnar ingot having a diameter of 80 mm and a height of 200 mm, and subjecting this ingot to a heat treatment wherein it is maintained for 1 hour at a predetermined temperature within the range from 800° to 1000° C. and then quenched by water cooling;

(b) a hot-wrought material formed by surface-grinding the ingot obtained in (a), hot-forging the ground ingot at 900° C. to form a material having a width of 100 mm, a thickness of 15 mm and a length of 500 mm, and subjecting this material to a heat treatment in which it is maintained for 1 hour at a predetermined temperature ranging from 800° to 1000° C. and then quenched by water cooling; and (c) a cold-wrought material formed by cold-rolling the hot-wrought material obtained in (b) to reduce the thickness to 5 mm, and subjecting the material to a heat treatment in which it is maintained for 1 hour at a predetermined temperature within the range of from 800° to 1000° C..

For comparison, alloy having the conventional composition shown in Table 1 was similarly prepared and cast using a mold to form a columnar ingot having a diameter of 80 mm and a height of 200 mm. This ingot was subjected to annealing process in which it was maintained for 1 hour at 700° C. and then allowed to cool to produce a cast material of the conventional copper alloy. Further, the annealed ingot was surface-ground and then subjected to hot forging at 900° C. to form a material having a width of 100 mm, a thickness of 15 mm and a length of 500 mm. This material was then subjected to annealing process in which it was maintained for 1 hour at 700° C. to produce a hot-wrought material of the conventional copper alloy.

Then, measurement of tensile strength and 0.2% yield strength was carried out on the resultant cast materials, hot-wrought materials and cold-wrought materials of the copper alloys 1 to 12 of the present invention, the comparative copper alloys 1 to 10, together with the cast material and hot-wrought material of the conventional copper alloy, for the purpose of evaluating the strength of each material. Further, in order to evaluate the resistance to corrosion by seawater, these materials were subjected to a seawater corrosion test in which each material was dipped in artificial seawater at ordinary temperature for 7 days and then the weight loss was measured. Further, in order to evaluate the weather resistance, each material was maintained for 2 hours in the atmosphere at 500° C. and then examined as whether or not an oxide layer was formed thereon. For evaluation of the cold formability, the hot-wrought materials and the cold-wrought materials were subjected to a 180° bending test to examine whether or not the bent portion of each material cracked.

Figure 2:
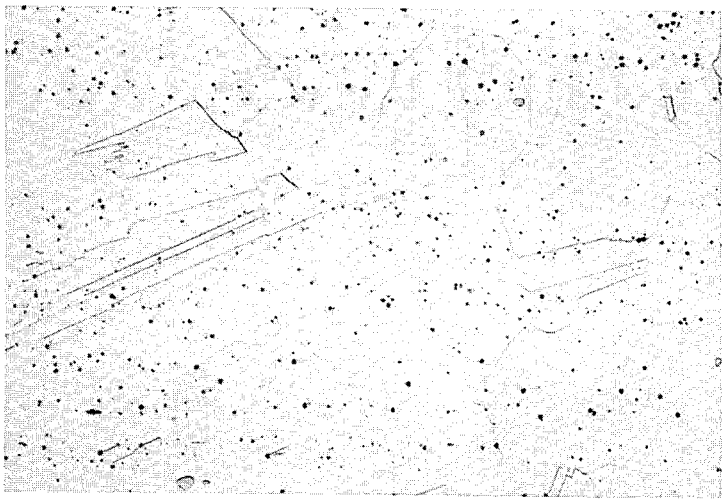
FIG. 2 is a metallurgical microscopic photograph showing the structure of a conventional copper alloy.

FIGS. 1 and 2 are metallurgical microscopic photographs (magnification: 400) respectively showing the structures of the hot-wrought materials of the copper alloy 2 of the present invention and the conventional copper alloy.

It should be noted that the above-described comparative copper alloys 1 to 10 have a composition in which the content of one of the constituent elements (the element marked with * in Table 1) is out of the range specified in the present invention.

The results of the above-described measurement and examination was shown in Table 1.

TABLE 1

| Alloys | Composition (percent by weight) Al | Ni | Fe | Mn | Ti | Co | B | Cu | Shape | Tensile Strength (kg/mm²) | Yield Strength (kg/mm²) | Weight loss on Corrosion (mg/cm²) | oxide layer | Crack in bent portion |
|---|---|---|---|---|---|---|---|---|---|---|---|---|---|---|
| Copper alloys of the present invention | | | | | | | | | | | | | | |
| 1 | 5.21 | 2.56 | 2.50 | 0.72 | 0.006 | 0.005 | 0.004 | bal. | A | 45 | 15 | 0.20 | not | none |

TABLE 1-continued

| Alloys | Composition (percent by weight) Al | Ni | Fe | Mn | Ti | Co | B | Cu | Shape | Tensile Strength (kg/mm²) | Yield Strength (kg/mm²) | Weight loss on Corrosion (mg/cm²) | oxide layer | Crack in bent portion |
|---|---|---|---|---|---|---|---|---|---|---|---|---|---|---|
| | | | | | | | | | B | 47 | 17 | 0.18 | formed not formed | none |
| | | | | | | | | | C | 49 | 19 | 0.17 | formed not formed | none |
| 2 | 7.12 | 2.70 | 2.45 | 0.67 | 0.004 | 0.003 | 0.005 | bal. | A | 51 | 19 | 0.18 | formed not formed | none |
| | | | | | | | | | B | 55 | 22 | 0.16 | formed not formed | none |
| | | | | | | | | | C | 57 | 24 | 0.15 | formed not formed | none |
| 3 | 8.91 | 2.90 | 2.40 | 0.50 | 0.008 | 0.006 | 0.003 | bal. | A | 57 | 22 | 0.17 | formed not formed | none |
| | | | | | | | | | B | 61 | 25 | 0.15 | formed not formed | none |
| | | | | | | | | | C | 64 | 27 | 0.14 | formed not formed | none |
| 4 | 7.45 | 0.53 | 2.60 | 0.45 | 0.008 | 0.002 | 0.023 | bal. | A | 49 | 21 | 0.23 | formed not formed | none |
| | | | | | | | | | B | 52 | 22 | 0.20 | formed not formed | none |
| | | | | | | | | | C | 54 | 25 | 0.19 | formed not formed | none |
| 5 | 7.36 | 3.81 | 2.95 | 0.63 | 0.007 | 0.003 | 0.004 | bal. | A | 60 | 25 | 0.16 | formed not formed | none |
| | | | | | | | | | B | 65 | 27 | 0.13 | formed not formed | none |
| | | | | | | | | | C | 67 | 28 | 0.13 | formed not formed | none |
| 6 | 7.87 | 2.35 | 0.51 | 0.72 | 0.002 | 0.008 | 0.003 | bal. | A | 49 | 21 | 0.20 | formed not formed | none |
| | | | | | | | | | B | 51 | 23 | 0.20 | formed not formed | none |
| | | | | | | | | | C | 53 | 24 | 0.18 | formed not formed | none |
| 7 | 7.53 | 2.83 | 3.90 | 0.70 | 0.005 | 0.003 | 0.002 | bal. | A | 57 | 23 | 0.21 | formed not formed | none |
| | | | | | | | | | B | 62 | 25 | 0.20 | formed not formed | none |
| | | | | | | | | | C | 64 | 26 | 0.18 | formed not formed | none |
| 8 | 7.30 | 2.65 | 2.45 | 0.13 | 0.003 | — | 0.094 | bal. | A | 47 | 18 | 0.18 | formed not formed | none |
| | | | | | | | | | B | 52 | 21 | 0.16 | formed not formed | none |
| | | | | | | | | | C | 55 | 23 | 0.15 | formed not formed | none |
| 9 | 7.83 | 2.56 | 2.55 | 2.94 | 0.003 | — | 0.0011 | bal. | A | 49 | 20 | 0.17 | formed not formed | none |
| | | | | | | | | | B | 55 | 22 | 0.14 | formed not formed | none |
| | | | | | | | | | C | 58 | 23 | 0.12 | formed not formed | none |
| 10 | 7.65 | 2.45 | 2.35 | 0.53 | 0.0012 | 0.97 | — | bal. | A | 49 | 19 | 0.18 | formed not formed | none |
| | | | | | | | | | B | 54 | 21 | 0.16 | formed not formed | none |
| | | | | | | | | | C | 56 | 24 | 0.17 | formed not formed | none |
| 11 | 7.55 | 2.49 | 2.46 | 0.63 | 0.96 | 0.003 | 0.003 | bal. | A | 52 | 22 | 0.18 | formed not formed | none |
| | | | | | | | | | B | 57 | 23 | 0.16 | formed not formed | none |
| | | | | | | | | | C | 60 | 24 | 0.14 | formed not formed | none |
| 12 | 7.77 | 2.52 | 2.48 | 0.62 | 0.005 | 0.0014 | — | bal. | A | 50 | 19 | 0.21 | formed not formed | none |
| | | | | | | | | | B | 53 | 21 | 0.20 | formed not formed | none |
| | | | | | | | | | C | 56 | 22 | 0.18 | formed not formed | none |
| | | | | | | Comparative Copper alloys | | | | | | | | |
| 1 | 4.50* | 2.70 | 2.45 | 0.60 | 0.005 | 0.003 | 0.003 | bal. | A | 38 | 11 | 0.35 | formed | found |
| | | | | | | | | | B | 40 | 13 | 0.30 | formed | none |
| | | | | | | | | | C | 42 | 15 | 0.25 | formed | none |
| 2 | 9.53* | 2.65 | 2.55 | 0.55 | 0.004 | 0.002 | 0.004 | bal. | A | 58 | 22 | 0.50 | formed | found |
| | | | | | | | | | B | 62 | 24 | 0.45 | formed | found |

TABLE 1-continued

| Alloys | Composition (percent by weight) Al | Ni | Fe | Mn | Ti | Co | B | Cu | Shape | Tensile Strength (kg/mm²) | Yield Strength (kg/mm²) | Weight loss on Corrosion (mg/cm²) | oxide layer | Crack in bent portion |
|---|---|---|---|---|---|---|---|---|---|---|---|---|---|---|
| | | | | | | | | | C | 65 | 26 | 0.40 | formed | found |
| 3 | 7.65 | —* | 2.53 | 0.46 | 0.006 | 0.003 | 0.004 | bal. | A | 45 | 15 | 0.40 | formed | found |
| | | | | | | | | | B | 48 | 18 | 0.38 | formed | found |
| | | | | | | | | | C | 49 | 18 | 0.28 | formed | found |
| 4 | 7.77 | 2.66 | —* | 0.49 | 0.004 | 0.004 | 0.003 | bal. | A | 46 | 15 | 0.30 | formed | found |
| | | | | | | | | | B | 49 | 18 | 0.25 | formed | none |
| | | | | | | | | | C | 51 | 19 | 0.25 | formed | none |
| 5 | 7.63 | 2.67 | 4.31* | 0.52 | 0.005 | 0.004 | 0.002 | bal. | A | 53 | 20 | 0.48 | formed | found |
| | | | | | | | | | B | 55 | 22 | 0.43 | formed | found |
| | | | | | | | | | C | 57 | 24 | 0.43 | formed | found |
| 6 | 7.60 | 2.68 | 2.63 | —* | 0.004 | 0.003 | 0.002 | bal. | A | 50 | 18 | 0.29 | formed | found |
| | | | | | | | | | B | 51 | 19 | 0.25 | formed | found |
| | | | | | | | | | C | 52 | 20 | 0.25 | formed | found |
| 7 | 7.63 | 2.83 | 2.60 | 0.60 | —* | 0.002 | 0.004 | bal. | A | 47 | 16 | 0.30 | formed | found |
| | | | | | | | | | B | 49 | 18 | 0.25 | formed | found |
| | | | | | | | | | C | 50 | 18 | 0.25 | formed | found |
| 8 | 7.49 | 2.76 | 2.40 | 0.55 | 1.25* | 0.006 | 0.003 | bal. | A | 50 | 19 | 0.32 | formed | found |
| | | | | | | | | | B | 53 | 21 | 0.29 | formed | found |
| | | | | | | | | | C | 56 | 23 | 0.26 | formed | found |
| 9 | 7.56 | 2.75 | 2.45 | 0.45 | 0.003 | 1.23* | — | bal. | A | 51 | 20 | 0.28 | formed | found |
| | | | | | | | | | B | 54 | 22 | 0.27 | formed | found |
| | | | | | | | | | C | 56 | 23 | 0.27 | formed | found |
| 10 | 7.59 | 2.63 | 2.50 | 0.50 | 0.004 | 0.003 | 0.152* | bal. | A | 50 | 19 | 0.25 | formed | found |
| | | | | | | | | | B | 52 | 21 | 0.24 | formed | found |
| | | | | | | | | | C | 54 | 23 | 0.24 | formed | found |
| Conventional copper alloy | 7.80 | 1.23 | 3.32 | 0.85 | — | — | — | bal. | A | 45 | 16 | 0.27 | formed | found |
| | | | | | | | | | B | 48 | 18 | 0.25 | formed | found |

A: cast material; B: hot-wrought material; C: cold-wrought material
The content marked with * is out of the range specified in the present invention.

It will be clear from the results shown in Table 1 that all the copper alloys 1 to 12 of present invention have strength and resistance to corrosion by seawater which are equal to or higher than those of the conventional copper alloy and further have weather resistance which is much superior to that of the prior art alloy, while the copper alloys according to the present invention have cold formability in which the conventional copper alloy is lacking. Clearly, these results are attributed to the fact that the copper alloys of the present invention have a substantially single phase structure consisting essentially of $\alpha$-phase as shown in FIG. 1, whereas the conventional copper alloy has a structure wherein a large amount of crystallized phases and precipitated phases are dispersed in the $\alpha$-phase matrix as shown in FIG. 2, and the dispersed phase inhibit attainment of excellent weather resistance and cold formability.

As will be understood from examination of the comparative copper alloys 1 to 10, it is clear that, if the content of any one of the constituent elements is out of the range specified in the present invention, at least one of the above-described properties is caused to deteriorate.

As has been described above, since the copper alloys of the present invention have high strength, excellent resistance to corrosion by seawater and superior weather resistance and cold formability, these alloys exhibit an excellent performance while maintaining their beautiful golden tone over a long period of time even in the case where they are employed as materials for Western tableware, vessels, fittings for buildings and decorative articles, in which it is necessary to employ materials having weather resistance and cold formability, not to mention the case where they are employed as materials for production of marine propellers, tube sheets of heat exchangers in desalination plant, various kinds of valve, automotive parts, oil-hydraulic parts, etc. Thus, the copper alloys according to the present invention have industrially useful and advantageous properties.

We claim:

1. A corrosion-resistant copper alloy consisting essentially, by weight, of:

Al: 5 to 9%;
Ni: 0.5 to 4%;
Fe: 0.5 to 4%;
MN: 0.1 to 3%;
Ti: 0.001 to 1% at least one selected from

Co: 0.001 to 1%; and
B: 0.001 to 0.1% the balance consisting of Cu and unavoidable impurities, said alloy having a structure consisting substantially of a single $\alpha$-phase matrix..

2. The corrosion-resistant copper alloy of claim 1, wherein said Al content is from 7 to 8%.

3. The corrosion-resistant copper alloy of claim 1, which contains both Co and B.

4. The corrosion-resistant copper alloy of claim 1, which contains Co and does not contain B.

5. The corrosion-resistant copper alloy of claim 1, which contains B and does not contain Co.

6. The corrosion-resistant copper alloy of claim 3, wherein said Al content is from 7 to 8%.

7. The corrosion-resistant copper alloy of claim 4, wherein said Al content is from 7 to 8%.

8. The corrosion-resistant copper alloy of claim 5, wherein said Al content is from 7 to 8%.

* * * * *